US006978642B2

(12) United States Patent
Morita et al.

(10) Patent No.: US 6,978,642 B2
(45) Date of Patent: Dec. 27, 2005

(54) WEFT KNITTING MACHINE WITH MOVABLE SINKER DEVICE

(75) Inventors: Toshiaki Morita, Wakayama (JP); Toshinori Nakamori, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/516,258

(22) PCT Filed: May 1, 2003

(86) PCT No.: PCT/JP03/05566

§ 371 (c)(1),
(2), (4) Date: Nov. 30, 2004

(87) PCT Pub. No.: WO03/102285

PCT Pub. Date: Dec. 11, 2003

(65) Prior Publication Data

US 2005/0183466 A1 Aug. 25, 2005

(30) Foreign Application Priority Data

May 30, 2002 (JP) ..... 2002-157735

(51) Int. Cl.[7] ..... D04B 15/06

(52) U.S. Cl. ..... 66/109

(58) Field of Search ..... 66/104, 105, 106, 66/107, 108, 109, 110, 90

(56) References Cited

U.S. PATENT DOCUMENTS

| | | | | |
|---|---|---|---|---|
| 3,024,633 | A * | 3/1962 | Kuntz | 66/60 R |
| 5,134,865 | A | 8/1992 | Shima et al. | |
| 5,138,849 | A * | 8/1992 | Stoll et al. | 66/104 |
| 6,092,396 | A * | 7/2000 | Schmid et al. | 66/106 |
| 6,415,633 | B2 | 7/2002 | Schmid et al. | |

FOREIGN PATENT DOCUMENTS

| | | |
|---|---|---|
| EP | 0 681 046 A1 | 11/1995 |
| EP | 0 681 046 B1 | 10/1998 |
| JP | 5-83657 | 11/1993 |
| JP | 9-31806 | 2/1997 |
| JP | 9-321806 A | 2/1997 |
| WO | WO 89/12708 | 12/1989 |
| WO | WO 89/12708 A1 | 12/1989 |

* cited by examiner

*Primary Examiner*—Danny Worrell
(74) *Attorney, Agent, or Firm*—Harness, Dickey & Pierce, P.L.C.

(57) ABSTRACT

A weft knitting machine with a movable sinker device capable of preventing yarn from being worn caused by repeatedly striking the yarn with a sinker energized by a spring to push down knitting fabric, wherein a stroke to which a yarn locking part (2*a*) at the tip of a sinker plate (2) is moved to a tooth port (6) by the energization of the spring (4) is increased at a first stage shown in (a) and decreased at a second stage shown in (b), the stroke is limited in (b) by locking a holding locking part (12*a*) of a holding member (12) to the holding locking part (2*d*) of the sinker plate (2), and a stage is switched to a second stage at a knitting portion where the yarn locking part (2*a*) repeatedly strikes the yarn to prevent the yarn from being thinned and fluffed.

5 Claims, 10 Drawing Sheets

(a)

(b)

WEFT KNITTING MACHINE WITH MOVABLE SINKER DEVICE

TECHNICAL FIELD

The present invention relates to a flat knitting machine provided with a movable sinker apparatus in which a force of a spring is applied to a sinker plate, so that the sinker plate can press down a previous loop of a knitting fabric that is knitted at a tooth portion.

BACKGROUND ART

Conventionally, in a needle bed of a flat knitting machine, knitting needles and sinkers are alternately positioned along the longitudinal direction. A knitting loop consists of a needle loop that is formed when a knitting needle pulls down a knitting yarn and a sinker loop that is formed when a sinker holds a knitting yarn between knitting needles when the needle loop is formed. The sinker is necessary also in order to perform knock-over smoothly to let a knitting needle through a previous loop that has been already knitted, when the knitting needle is pulled into a needle bed so as to form a new knitting loop. Furthermore, when a knitting needle moves forward to a tooth portion so as to receive a fed knitting yarn at its front end portion, the sinker serves to prevent "yarn moving upward" in which a knitting loop that has been already formed goes up toward the front end portion in accordance with the movement of the knitting needle.

European Patent European Patent EP-B1 0681046, for example, discloses a sinker apparatus that can move forward to a tooth portion and press a previous loop. This European Patent Publication discloses the configuration in which a cam mechanism that is provided in a carriage moves the sinker forth into/back from the tooth portion when the carriage moves along the longitudinal direction in the needle bed. The sinker slides in a groove on an auxiliary floor that is provided above the knitting needle, and the cam mechanism controls the position of the sinker so that the sinker is not in contact with the knitting loop after the travel of the carriage. The sinker can hold its position by a frictional force in the groove in which the sinker slides, and can press a previous loop by moving forward to the tooth portion, if necessarily, after the front end portion of the knitting needle is fed with a yarn. The cam mechanism is driven by a stepping motor. The stepping motor can perform driving independently while the carriage is in motion.

In Japanese Examined Patent Publication JP-B2 5-83657 (1993), for example, the applicant of the present invention discloses a sinker apparatus in a flat knitting machine in which a sinker plate that is positioned between knitting needles and that presses down a previous loop at a knitting yarn stopping portion at its front end portion can move forward to a tooth portion that is formed between the front and the rear needle beds by a force of a spring. Since previous loops are pulled down each by each, such a sinker apparatus with a force of a spring can reliably apply a pulling down force to knitting stitches even when a knitting operation is performed so that a pulling down force is not applied uniformly to the entire a knitting fabric. When a greater force than a force of a spring to the sinker plate is applied to a knitting yarn, the front end portion of the sinker plate can automatically move back from the tooth portion, so that too strong a force is not applied to the knitting yarn. The apparatus is also provided with a cam mechanism that automatically moves the sinker plate back from the tooth portion when a knitting needle is fed with a knitting yarn.

In Japanese Unexamined Patent Publication JP-A 9-31806(1997), the applicant of the present invention also discloses a movable sinker apparatus that performs an operation to press a previous loop by applying a force of a spring to a sinker plate, and an operation to hold the sinker plate at a rest position where the sinker plate is withdrawn from a tooth portion by a cam mechanism for switching of the operation between holding at the rest position and releasing the sinker plate, which is provided in a carriage. For example, when knitting with a thick knitting yarn, there is a possibility that a knitting yarn stopping portion of the sinker plate may scratch a knitting fabric in a racking operation that causes relative movements of the front and the rear needle beds in the longitudinal direction when the sinker plate is constantly at the tooth portion in order to press a previous loop. In order to prevent this possibility, the sinker plate is held at the rest position in which the sinker plate is withdrawn from the position where the front end portion presses a previous loop at the tooth portion, after the travel of the carriage. An swing plate for locking is provided in the needle bed as a mechanism that holds the sinker plate at the rest position by resisting the spring force. A cam for controlling the sinker that is provided in the carriage swings the swing plate for locking, so that the sinker plate is held at the rest position or released. The cam mechanism that is provided in the carriage also forces the sinker plate to be withdrawn to the rest position when a knitting needle is fed with a knitting yarn.

The sinkers to which a force of a spring is not applied such as disclosed in European Patent EP-B1 0681046 are not capable of pulling down a knitting fabric sufficiently for each knitting stitch. In the sinkers that press down a previous loop by a force of a spring such as disclosed in Japanese Examined Patent Publication JP-B2 5-83657(1993) and Japanese Unexamined Patent Publication JP-A 9-31806 (1997), after a sinker plate is withdrawn from a tooth portion at a position where a knitting needle is fed with a yarn, a sinker plate to which a force of a spring is applied returns to the state where the front end portion presses down a previous loop. Since this sinker plate returns while a force of a spring is applied, the front end portion of the sinker plate hits a knitting yarn of a previous loop. For example, when a binding stitch treatment that narrows the width of a knitting fabric is performed a carriage needs to move back and forth a plurality of times in order to knit one course. In this procedure, a new knitting loop is not formed even by the travel of the carriage, and the front end portion of the sinker plate repeats to press down and release a previous loop with respect to the knitting needle that simply holds the knitting stitch that has been already knitted. When the front end portion of the sinker plate repeatedly hits a knitting yarn, "yarn thinning" in which a yarn is stretched to be thin, and "nap" in which the fiber of a knitting yarn is loosened are likely to occur, depending on the characteristics of the knitting yarn. When a knitting yarn is worn out by "yarn thinning," "nap," or the like, the texture of the knitting fabric is damaged.

DISCLOSURE OF INVENTION

An object of the invention is to provide a flat knitting machine provided with a movable sinker apparatus that can prevent worn-out of a knitting yarn caused when a sinker, to which a force of a spring is applied for pressing down a knitting fabric, repeatedly hits the knitting yarn.

The present invention is a flat knitting machine comprising:

a movable sinker apparatus including a plurality of sinker plates which are disposed along a longitudinal direction of a needle bed, and to which a force of a spring is applied so that a knitting yarn stopping portion at its front end portion moves forward to a tooth portion formed between the front and the rear needle beds that are opposed to each other, in the movable sinker apparatus the knitting yarn stopping portion being withdrawn from the tooth portion at a position where a knitting needle is fed with a yarn and being moved forward to the tooth portion at least at a time of knock-over after forming a new loop, by an action of a carriage moving along the longitudinal direction of the needle bed, so that a previous loop is pressed down, the flat knitting machine comprising:

switching means provided in the carriage for switching an amount of movement of the knitting yarn stopping portion of the sinker plate forward to the tooth portion by a force of a spring to a plurality of stages including a first stage with the largest amount of movement in one course, at a predetermined switching position that is outside a range in which a knitting needle performs a knitting operation; and holding means provided for each sinker plate, for holding a switched state when the amount of movement of the sinker plate forward to the tooth portion is switched to a second stage in which the amount is smaller than that in the first stage by the switching means.

Furthermore, in the invention it is characterized in that the sinker plate includes an abutting portion that is brought in contact with the holding means in the second stage, and the switching means lets the sinker plate withdraw from the tooth portion by resisting the spring force at a position where the knitting needle is fed with a yarn and at the switching position, and switches to a state in which the abutting portion of the sinker plate is brought in contact with the holding means when switching to the second stage.

Furthermore, in the invention it is characterized in that the holding means includes a projection portion with which the switching means can be in contact for switching such that different positions are taken between the first stage and the second stage, and the switching means includes a pair of press portions that are opposed to each other with a gap wider than that in which the projection portion of the holding means is displaced between the first stage and the second stage, presses the projection portion of the holding means by either one of the press portions when switching to the first stage or to the second stage, and can switch to a state in which neither of the press portions presses the projection portion of the holding means.

Furthermore, in the invention it is characterized in that the holding means holds the switched state by being engaged with the abutting portion of the sinker plate in the second stage, a plate spring including a protrusion that can hold the switched stage of the holding means in each of the first stage and the second stage is further provided, and the holding means is displaced by surmounting the protrusion of the plate spring when the switching means switches between the first stage and the second stage.

Furthermore, in the invention it is characterized in that the switching means includes:

a swing cam in which a pair of press portions are formed, and that is swingingly displaced so as to include an area in which the projection portion of the holding means is displaced between the press portions, a stepping motor whose rotational state is controlled in accordance with an electrical command, and a linking mechanism that swingingly displaces the swing cam based on a rotational power of the stepping motor.

BRIEF DESCRIPTION OF DRAWINGS

The objects, the features, and the advantages of the invention will be further clarified by the following detailed descriptions and drawings.

BEST MODE FOR CARRYING OUT THE INVENTION

Hereinafter, preferred examples of the invention will be described in detail with reference to the accompanying drawings.

Figure 1:
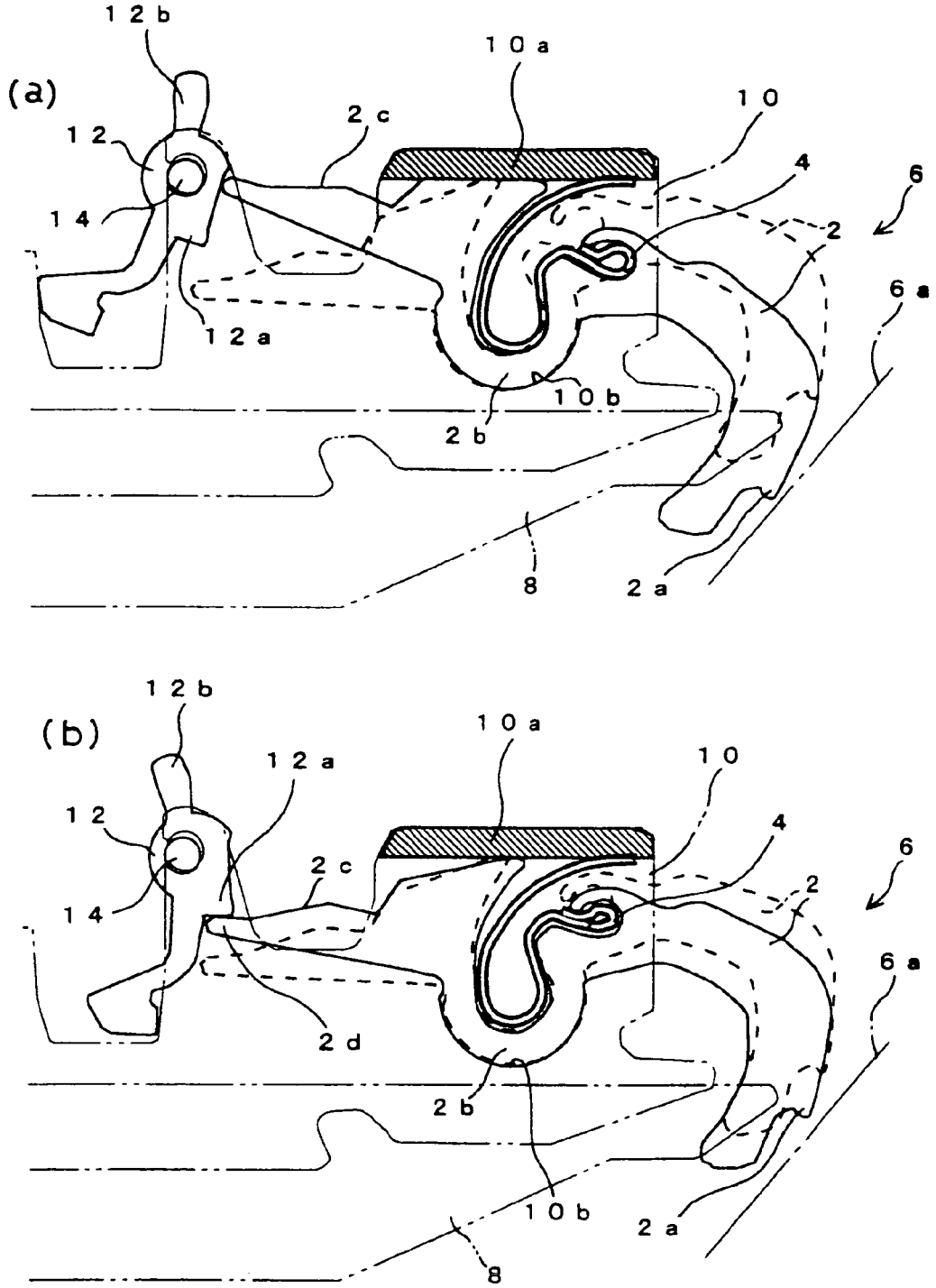
FIG. 1 shows cross-sectional views of the front end portion of a needle bed, which comparatively illustrate strokes by swinging displacement of a sinker plate 2 when the main components of a movable sinker apparatus are switched between a first stage and a second stage as an embodiment of the invention.

FIG. 1 shows a schematic configuration of a movable sinker apparatus portion in a flat knitting machine that is provided with a movable sinker apparatus as an embodiment of the invention. The movable sinker apparatus of this embodiment has a sinker plate 2 that can be displaced by swinging, and that is capable of pressing down a previous loop in a knitting operation by the action that a knitting yarn stopping portion 2*a* at a front end portion of the sinker plate 2 moves forward to a tooth portion 6 by a force of a spring 4. The basic operations and functions of the sinker plate 2 and the flat knitting machine (not shown) are the same as those described in Japanese Examined Patent Publication JP-B2 5-83657 (1993) and Japanese Unexamined Patent Publication JP-A 9-31806(1997). In this embodiment, the amount of movement of the knitting yarn stopping portion 2*a* forward to the tooth portion 6 can be switched between two stages. More specifically, the amount of movement can be switched between a first stage where the knitting yarn stopping portion 2*a* moves forward to the tooth portion 6 with a long stroke as shown in FIG. 1(*a*), and a second stage where the knitting yarn stopping portion 2*a* moves forward to the tooth portion 6 with a shorter stroke than that in the first stage, as shown in FIG. 1(*b*).

In each stage, the spring 4 moves the sinker plate 2 forward to the tooth portion 6 as indicated by the solid line. When a greater force than that of the spring 4 is applied to the knitting yarn stopping portion 2*a*, the sinker plate can be displaced by swinging into the position indicated by the broken line. In both the first stage and the second stage, the state indicated by the broken line is the same. Therefore, a pivotal stroke by swinging displacement is longer in the first stage than in the second stage. The sinker plate 2 pivots about a pivot portion 2*b* as the supporting point. The state of the sinker plate 2 indicated by the broken line is also realized by pressing down a press portion 2*c* from above, which is positioned on the opposite side of the knitting yarn stopping portion 2*a* with respect to the pivot portion 2*b*. When letting a knitting needles catch a knitting yarn, the press portion 2*c* is pressed down so that the knitting yarn stopping portion 2*a* is withdrawn from the tooth portion 6 so as to avoid a contact with a knitting yarn that is supplied from a yarn feeding member.

The tooth portion 6 is formed between the front and the rear needle beds that are opposed to each other in a flat knitting machine including at least a pair of needle beds of the front and the rear. The pair of needle beds of the front and the rear are positioned in a plane symmetrical manner with respect to a symmetry plane 6*a* that is almost vertical to the needle beds. The needle beds are inclinated being high on the side of the tooth portion 6 and becoming lower as being moved away from the tooth portion 6. However, for convenience, the configuration is shown such that the symmetry plane 6*a*, which actually stands in the vertical direction, is inclinated, and the direction from/to which the knitting needles move back and forth in the needle beds lies horizontally in the lateral direction. A needle bed board 8 on which a plurality of grooves are formed is provided in the needle beds along the longitudinal direction. Needle plates 10 are inserted into the respective grooves of the needle bed board 8, and knitting needles are disposed at needle grooves formed between the needle plates 10. The knitting needles moves forth into/back from the tooth portion 6 by an action of a carriage moving along the longitudinal direction of the needle bed, and a knitting operation of a knitting fabric is performed. The sinker plate 2 is disposed in the grooves on the needle bed board 8 together with the needle plate 10, in the vicinity of the front end portion of the needle bed board 8 on the side of the tooth portion 6. The upper portion of the needle plate 10 is provided with a stopper 10*a* such as an iron band. The stopper 10*a* defines the upper limit that the sinker plate 2 makes an angular displacement clockwise by a force of the spring 4 in the first stage as shown in the FIG. 1(*a*). The upper end portion of the spring 4 is also pressed by the stopper 10*a*. A pivot groove 10*b* that pivotally supports the pivot portion 2*b* of the sinker plate 2 is formed in a middle portion of the needle plate 10.

As shown in FIG. 1(*b*), an action of a holding member 12 defines the movement of the sinker plate 2 forward to the tooth portion 6 by a force of the spring 4 in the second stage. The holding member 12 can be displaced by swinging about an axis 14, and can limit the movement of the knitting yarn stopping portion 2*a* at the front end portion of the sinker plate 2 forward to the tooth portion 6 be shorter than in the first stage, by being engaged with a stopping portion for holding 2*d* at the edge portion of the sinker plate 2. In the second stage, the sinker plate 2 also can be displaced by swinging into the position indicated by the broken line by tension of a knitting yarn that is applied to the knitting yarn stopping portion 2*a*, or a force to press down the press portion 2*c*. The switching between the first stage and the second stage is performed when a projection portion 12*b* that is projected above from the holding member 12 is pressed from the right or left direction in the drawings.

Figure 2:
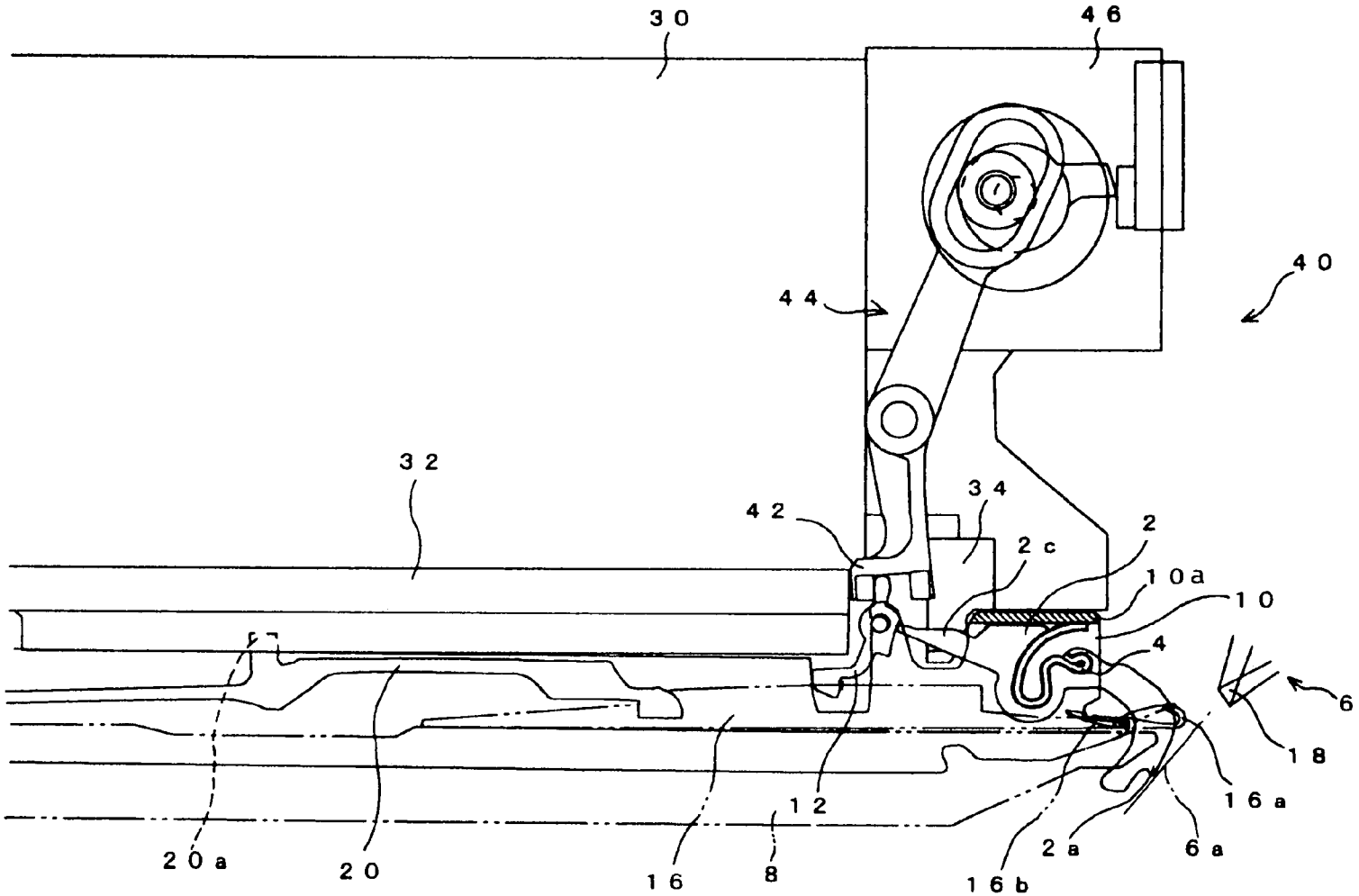
FIG. 2 is a schematic cross-sectional view of the entire needle bed that includes the portion shown in FIG. 1.

FIG. 2 shows a configuration for performing a knitting operation of a knitting fabric in the needle beds provided with the movable sinker apparatuses in FIG. 1. A knitting needle 16 is positioned between the needle plates 10 in each needle bed, and can perform a knitting operation by moving the front end portion of the needle forth to/back from the tooth portion 6. In this embodiment, a latch needle is used as the knitting needle 16. A hook 16*a* is formed at the front end portion of the knitting needle 16, and a latch 16*b* can open or close an opening portion of the hook 16*a*. The latch 16*b* opens or closes in accordance with an operation of a knitting yarn for knitting. When the knitting needle 16 moves forward to the tooth portion 6, in the state where both the hook 16*a* and the latch 16*b* of the knitting needle 16 are open, the opening portion of the hook 16*a* can catch a knitting yarn from a yarn feeder 18 as a yarn feeding member. It should be noted that when a knitting yarn is fed in this manner, the press portion 2*c* is pressed down so that the knitting yarn stopping portion 2*a* of the sinker plate 2 is withdrawn from the tooth portion 6.

The knitting needle 16 is moved for knitting by the action of a knitting cam lock 32 that is provided in the carriage 30 on a control butt 20*a* of a needle jack 20 that is connected on the edge side of the knitting needle 16. The yarn feeder 18 moves in connection with the movement of the carriage 30 in the longitudinal direction of the needle bed. However, a plurality of devices can be used in turn as a yarn feeder 18, and it is possible to switch knitting yarns by changing the yarn feeders 18. The carriage 30 is provided with a fixed presser 34 that presses down the press portion 2*c* of the sinker plate 2, and lets the sinker plate 2 withdraw from the tooth portion 6 in connection with the operation of the knitting needle 16 by the knitting cam lock 32. The switching between the first stage and the second stage as shown in FIGS. 1(*a*) and 1(*b*) is performed in the following manner. While the fixed presser 34 presses down the press portion 2*c* of the sinker plate 2, the holding member 12 is displaced by swinging by an swing cam 42 of a switching mechanism 40 that is provided in the carriage 30. A swing cam 42 is displaced by swinging by a driving force from a stepping motor 46 via a linking mechanism 44.

Figure 3:
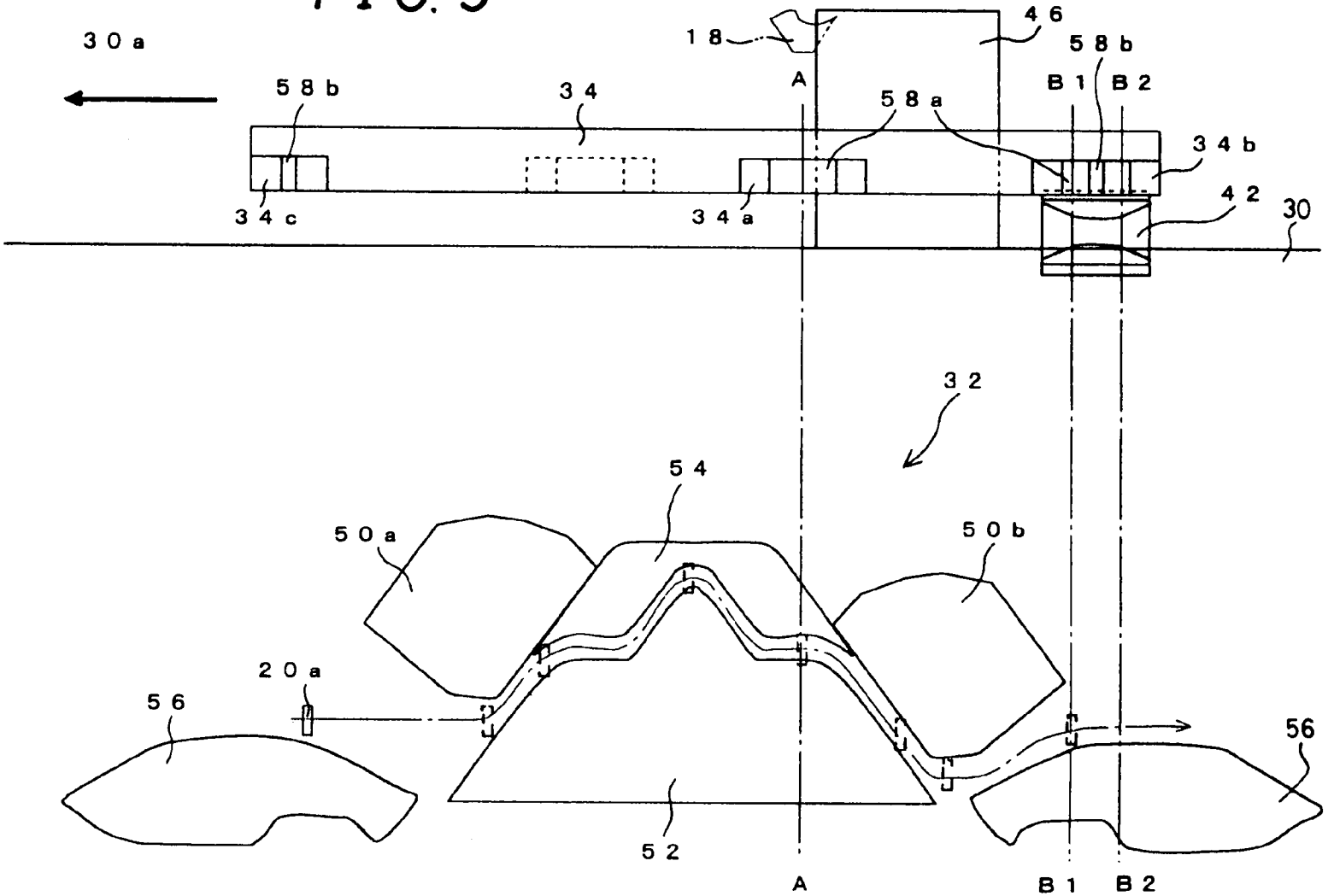
FIG. 3 is a schematic bottom view of a carriage 30 in FIG. 2.

FIG. 3 shows a diagram viewed from the bottom of the carriage 30 in FIG. 2 with the side of the tooth portion 6 shown above. The knitting cam lock 32 includes knitting cams 50*a* and 50*b*, a raising cam 52, a bridge cam 54, and a guide cam 56, and guides the control butt 20*a* of the needle jack 20 in FIG. 2. When the carriage 30 moves in the direction indicated by an arrow 30*a*, knock-over is performed in the following manner. The raising cam 52 moves the knitting needle 16 in FIG. 2 forward to the tooth portion 6, so as to let the knitting needle catch a knitting yarn from the yarn feeder 18 at the yarn feeding position indicated by reference symbol A, and then the knitting cam 50*b* moves the knitting needle 16 backward. A press cam 34*a* that includes a press surface 58*a* is provided at the yarn feeding position indicated by A. After the knock-over, the swing cam 42 switches at the switching position between positions B1 and B2 in which a knitting needle does not perform a knitting operation. A press cam 34*b* that includes a press surface 58*a* is provided between the switching positions B1 and B2 in order to operate the fixed presser 34.

However, the press cam 34*a* changes its position in accordance with the direction to which the carriage 30 moves. When the carriage 30 moves in the direction opposite to the arrow 30*a*, the press cam 34*a* is pressed by the press portion 2*c* of the sinker plate 2 in FIG. 2, and is moved to the position indicated by the broken line. The yarn feeding position by the yarn feeder 18 also moves to the position to which the press cam 34*a* is moved. When the carriage 30 moves in the direction opposite to the arrow 30*a*, the swing cam 42 switches at the switching position between positions B1 and B2 before a knitting operation by the knitting needle 16.

Furthermore, the press cam 34*b* is provided with a press protrusion 58*b* that presses down the press portion 2*c* of the sinker plate 2 further than at the time of the switching of the swing cam 42. A similar press protrusion 58*b* is provided on a press cam 34*c* that is positioned symmetrically to the press cam 34*b* with respect to the centerline of the knitting cam lock 32. The press protrusion 58*b* is provided so as to press the previously-knitted loop reliably at the knitting yarn stopping portion 2*a* of the sinker plate 2. In other words, the press cam 34*b* for the switching of the swing cam 42 also serves as a cam that presses a previous loop. Although it is possible to provide another cam at another position, the configuration of the fixed presser 34 can be simplified when one cam serves the two purposes.

Figure 4:
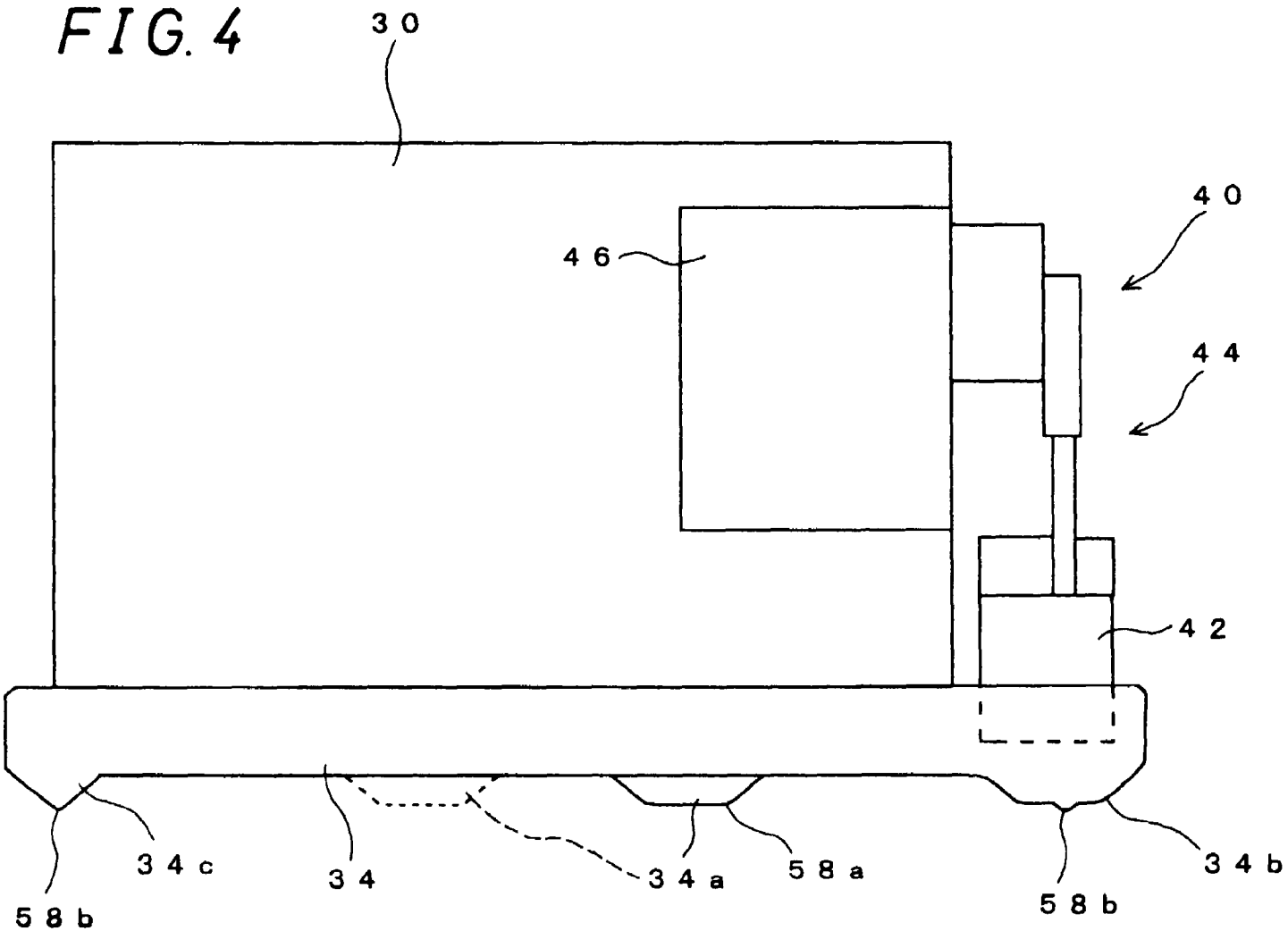
FIG. 4 is a schematic right side view of the carriage 30 in FIG. 2.

FIG. 4 shows the carriage 30 and the switching mechanism 40 when viewed from the right side in FIG. 2. The front end portions of the press cams 34*a*, 34*b*, and 34*c* are projected from the lower surface of the fixed presser 34, and press down the press portion 2*c* of the sinker plate 2 shown in FIG. 2. As described above, the middle press cam 34*a* is switched between the position indicated by the solid line and the position indicated by the broken line, in accordance with the direction to which the carriage 30 moves back and forth along the longitudinal direction of the needle bed.

Figure 5:
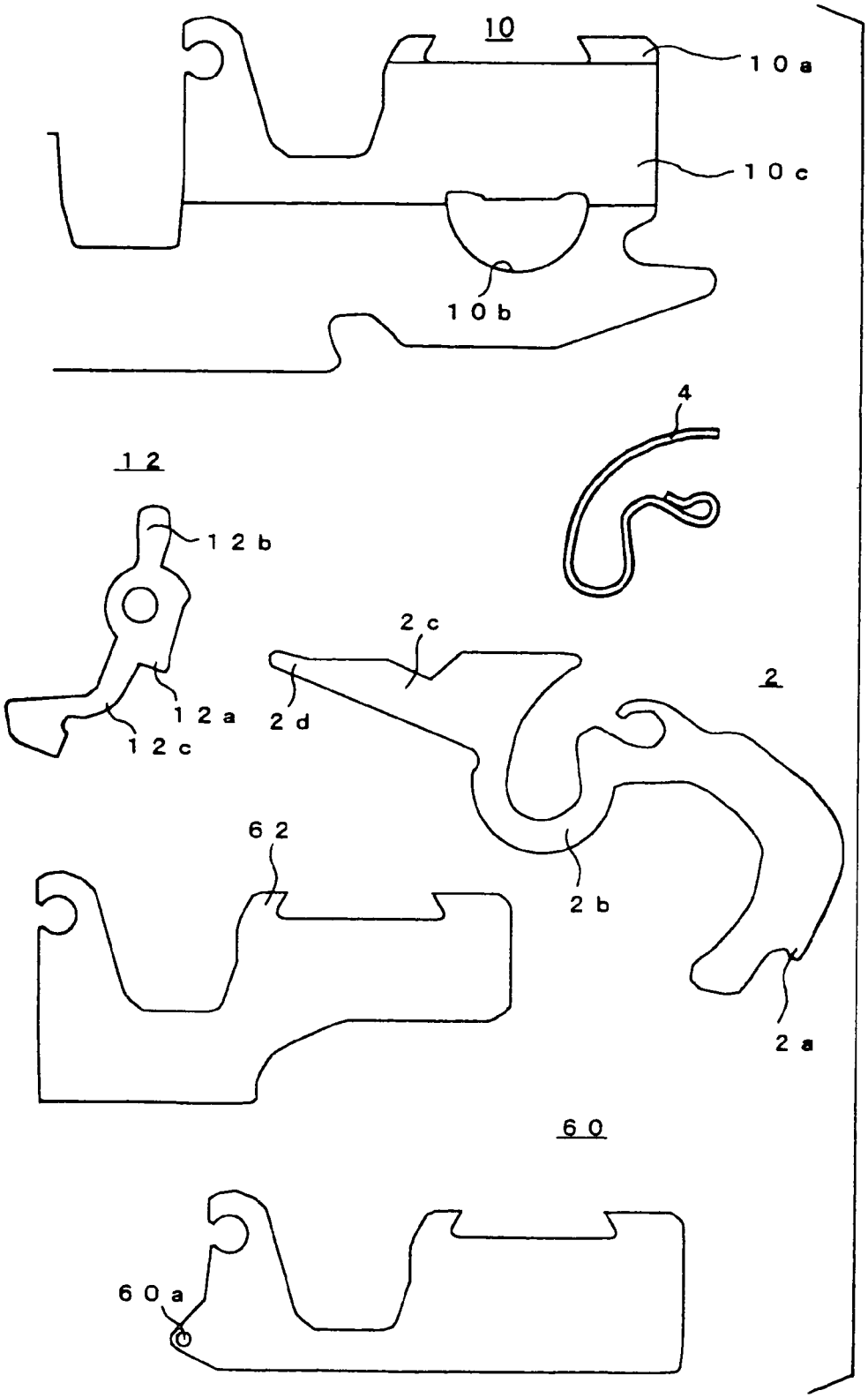
FIG. 5 shows views of components of the movable sinker apparatus shown in FIG. 1.

FIG. 5 shows the shapes of the main components that constitute the movable sinker apparatus shown in FIG. 1. The needle plate 10 is shown on the side of the tooth portion 6 in FIG. 1. A part of the stopper 10*a* is formed as a thick wall portion at the upper portion of the needle plate. A recess is formed in the upper thick wall portion, and an iron band is inserted therein. The lower half portion of the needle plate 10 is also formed as a thick wall portion where the pivot groove 10*b* is formed. The sinker plate 2, the spring 4, and the holding member 12 are accommodated in the middle portion 10*c* that is thinner than the thick wall portion that is formed at the upper portion and the lower half portion of the needle plate 10. Two spacers 60 and 62 (not shown in FIGS. 1 and 2) are also accommodated in the middle portion 10*c*. The spacer 60 is made of a thin plate spring, and includes a protrusion 60*a* in the vicinity of the position in which the holding member 12 is accommodated. The spacer 62 has the same thickness as that of the knitting needle 16, and is disposed so as to fill the space above the knitting needle 16.

Figure 6:
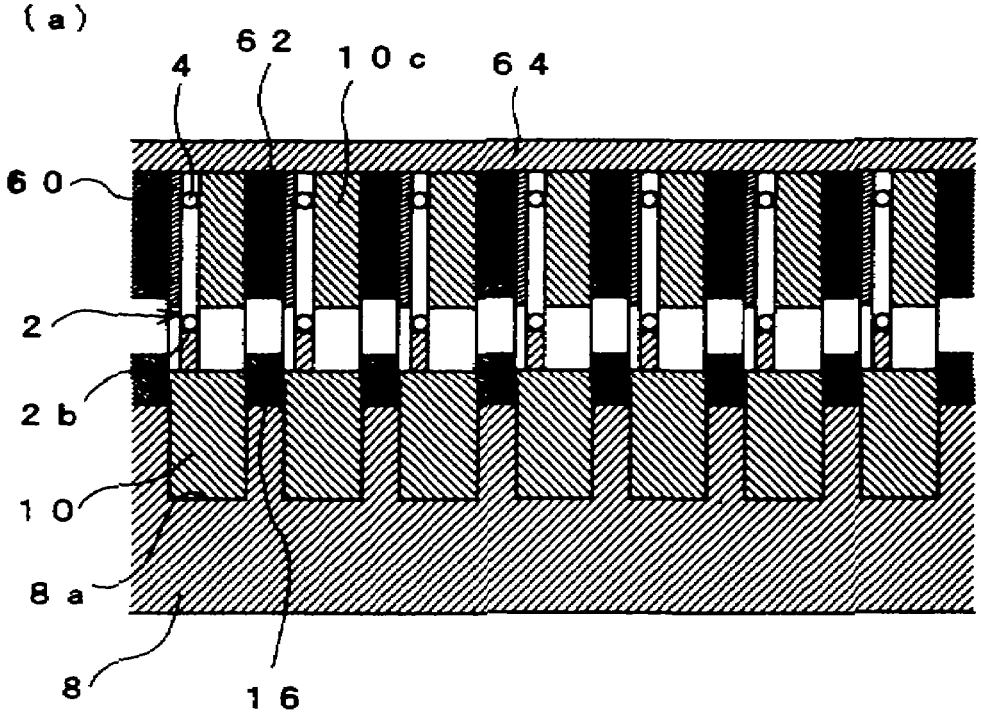
FIG. 6 shows cross-sectional views of the needle bed taken along the longitudinal direction, which illustrate the configuration in the vicinity of a pivot portion 2*b* of the sinker plate 2 and a partial configuration in the vicinity of a protrusion 60*a* of a spacer 60 in the movable sinker apparatus in FIG. 1.
Figure 6:
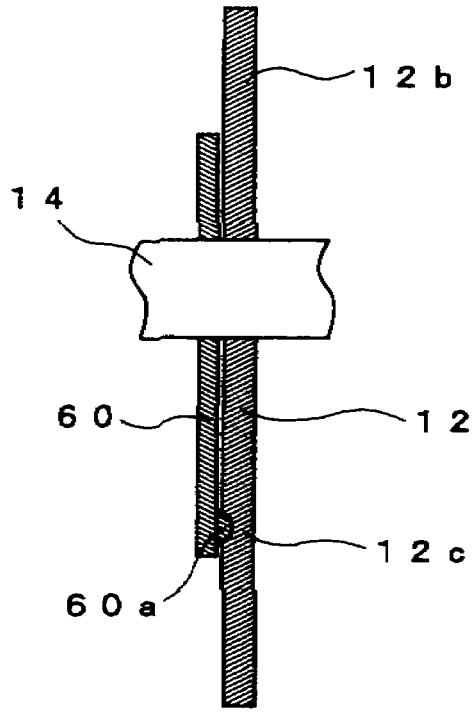

FIG. 6 shows a cross-sectional configuration of the needle bed taken along the longitudinal direction. FIG. 6(*a*) shows the vicinity of the pivot portion 2*b* of the sinker plate 2. A grooves 8*a* are formed in the needle bed board 8 at a constant pitch, and the thick wall portions at the lower half portion of the needle plate 10 are inserted therein. The thicker spacer 62 and the knitting needle 16 are accommodated in the space between the needle plates 10. The thinner spacer 60, the sinker plate 2, and the spring 4 are accommodated between the spacer 62 and the knitting needle 16, and the thin wall portion 10*c* of the needle plate 10. The upper portions of the needle plate 10 and the spacer 62 are pressed by an iron band 64 that extends in the longitudinal direction of the needle bed. FIG. 6(*b*) shows an enlarged view of a partial configuration in the vicinity of the protrusion 60*a* of the spacer 60. The protrusion 60*a* can hold the position of the first stage by being in contact with one side of an abutting portion 12*c* of the holding member 12. When the protrusion is in contact with the other side of the abutting portion 12*c*, the position of the second stage can be held.

Figure 7:
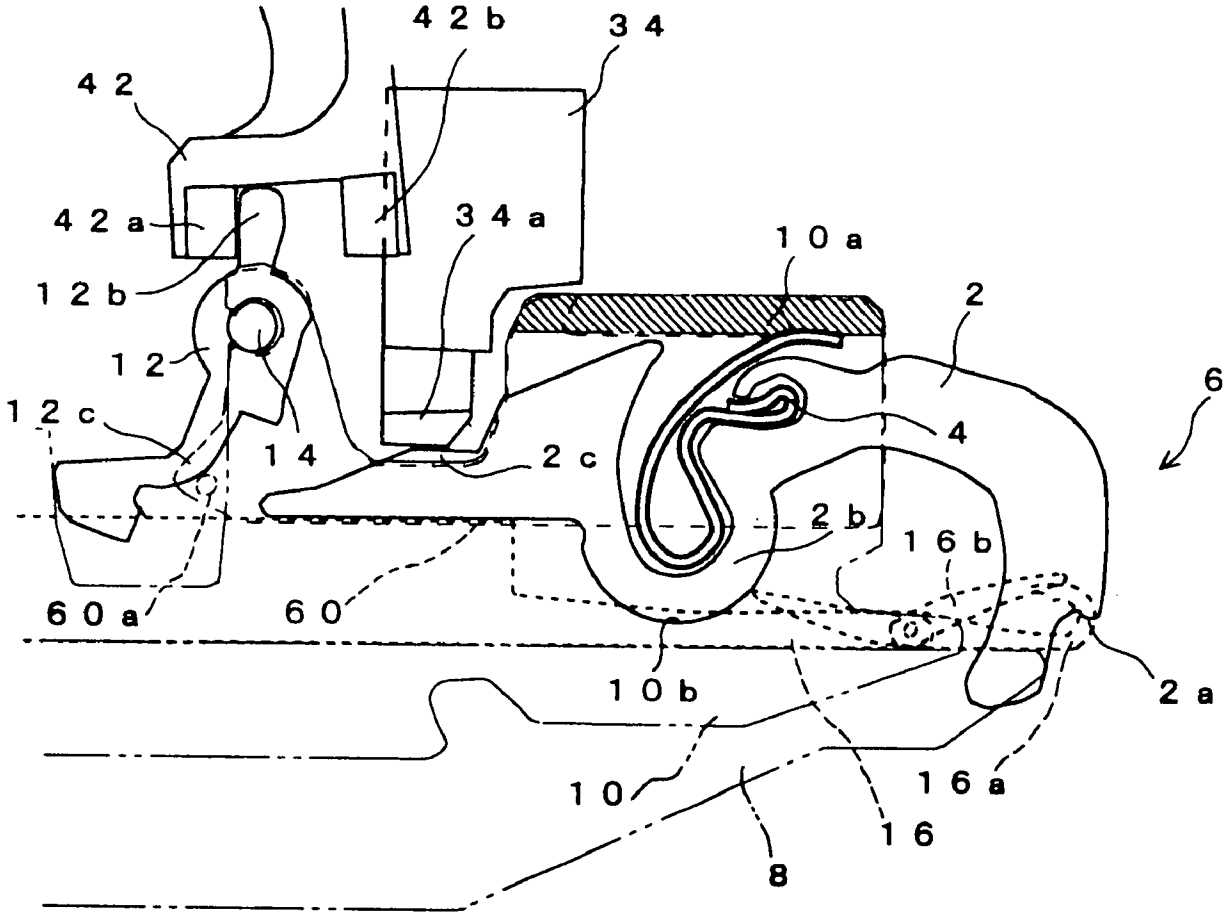
FIG. 7 is a partial cross-sectional view showing the state where the sinker plate 2 in FIG. 1 is switched to the first stage.

FIG. 7 shows the state where the sinker plate 2 is switched to the first stage as shown in FIG. 1(*a*) by operating the swing cam 42 at the switching position between B1 and B2 shown in FIG. 3. The press cam 34*a* of the fixed presser 34 presses down the press portion 2*c* of the sinker plate 2, and the press portion 42*a* of the swing cam 42 presses the projection portion 12*b* of the holding member 12 from the left in FIG. 7, so that the portion below the axis 14 of the holding member 12 is moved away from the sinker plate 2. In this state, the protrusion 60*a* of the spacer 60 is brought in contact with one side of the abutting portion 12*c* that is positioned at the portion below the axis 14 of the holding member 12. When the carriage 30 moves to stop the press cam 34*a* from pressing down the press portion 2*c*, the sinker plate 2 can be displaced by swinging by a force of the spring 4 until the sinker plate is brought in contact with the stopper 10*a* of the needle plate 10 in the state shown in FIG. 1(*a*), and thus, the knitting yarn stopping portion 2*a* can be moved forward to the tooth portion 6. Since the protrusion 60*a* of the spacer 60 is in contact with one side of the abutting portion 12*c* of the holding member 12, the holding member 12 can hold the position of the first stage.

Figure 8:
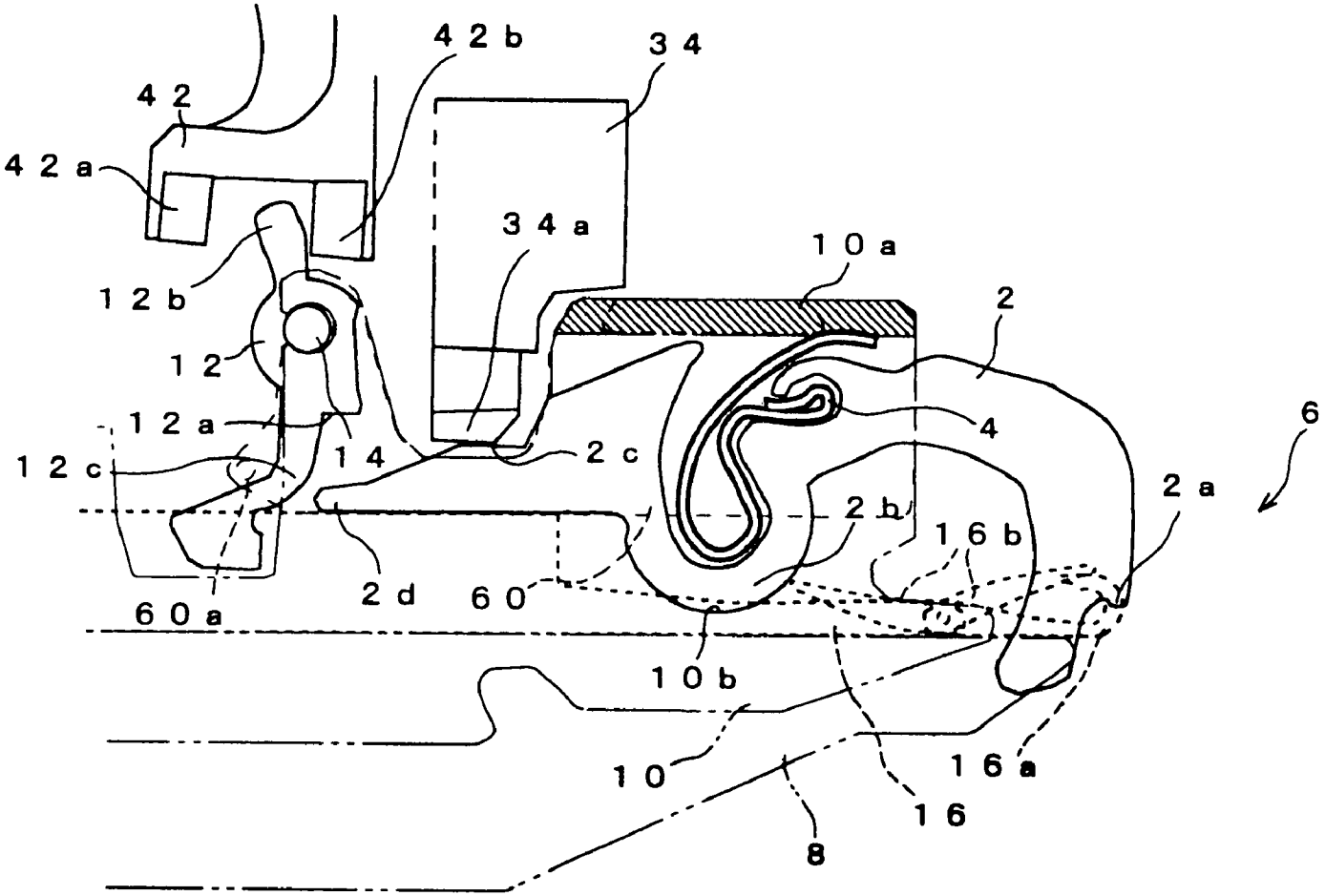
FIG. 8 is a partial cross-sectional view showing the state where the sinker plate 2 in FIG. 1 is switched to the second stage.

FIG. 8 shows the state where the sinker plate 2 is switched to the second stage as shown in FIG. 1(*b*) by operating the swing cam 42 at the switching position between B1 and B2 shown in FIG. 3. The press cam 34*a* of the fixed presser 34 presses down the press portion 2*c* of the sinker plate 2. The press portion 42*b* of the swing cam 42 presses the projection portion 12*b* of the holding member 12 from the right in the drawings, to make the portion below the axis 14 of the holding member 12 closer to the sinker plate 2 with an angular displacement about the axis 14. The abutting portion 12*c* of the holding member 12 presses the protrusion 60*a* of the spacer 60 in the state as shown in FIG. 7. The thin spacer 60 is bended and deformed so that the protrusion 60*a* moves backward. Then the holding member surmounts the protrusion 60*a* and is switched to the position of the second stage. The position of the second stage is held by the contact of the protrusion 60*a* of the spacer 60 with the other side of the abutting portion 12*c* of the holding member 12. Since the stopping portion for holding 12*a* of the holding member 12 is in the position where it is possible to be engaged with the stopping portion for holding 2*d* of the sinker plate 2, when the carriage 30 moves to stop the press cam 34*a* from pressing down the press portion 2*c*, the sinker plate 2 is displaced by swinging by a force of the spring 4 until the stopping portion for holding 2*d* is brought in contact with the stopping portion for holding 12*a* of the holding member 12. In the second stage, it is possible to move the knitting yarn stopping portion 2*a* forward to the tooth portion 6 with a shorter stroke than in the first stage.

Figure 9:
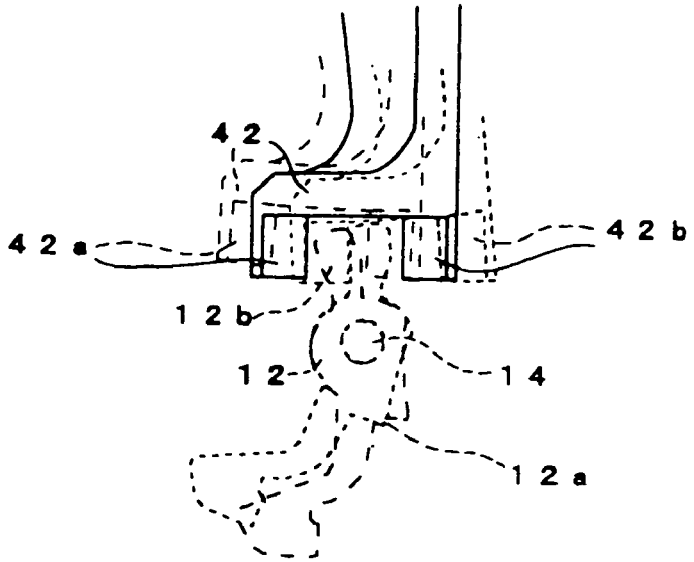
FIG. 9 is a partial cross-sectional view showing the state of the third stage where the sinker plate 2 in FIG. 1 stays in the switched state.

FIG. 9 shows the state where the switching of the switching mechanism 40 is not performed. The gap between the press portions 42*a* and 42*b* of the swing cam 42 is set to be wider than that of the projection portion 12*b* of the holding member 12 in an swinging displacement. When the switching position of the swing cam 42 is set to be at a middle position between the first stage and the second stage, the travel can be attained without a contact with the projection portion 12*b* of the holding member 12 that has been switched to the first stage or the second stage. Therefore, the switched state of the first stage or the second stage can be kept whichever the switching is. Holding the position of the first stage or the second stage can be possible also by the contact of the protrusion 60*a* with one or the other side of the abutting portion 12*c* of the holding member 12, as shown in FIG. 7 or 8. Holding the position in this manner is also possible by an action of sliding resistance that is generated by bending for example, instead of the engagement with the protrusion 60*a*. Holding the position of the second stage can be also maintained by the engagement of the stopping portion for holding 12*a* of the holding member 12 with the stopping portion for holding 2*d* of the sinker plate 2. The switching position at each stage can be set precisely, for example, in the following manner. An origin is set and is detected by a sensor. The switching position is set in accordance with the number of pulses for driving a stepping motor 46, using the origin as the reference.

Figure 10:
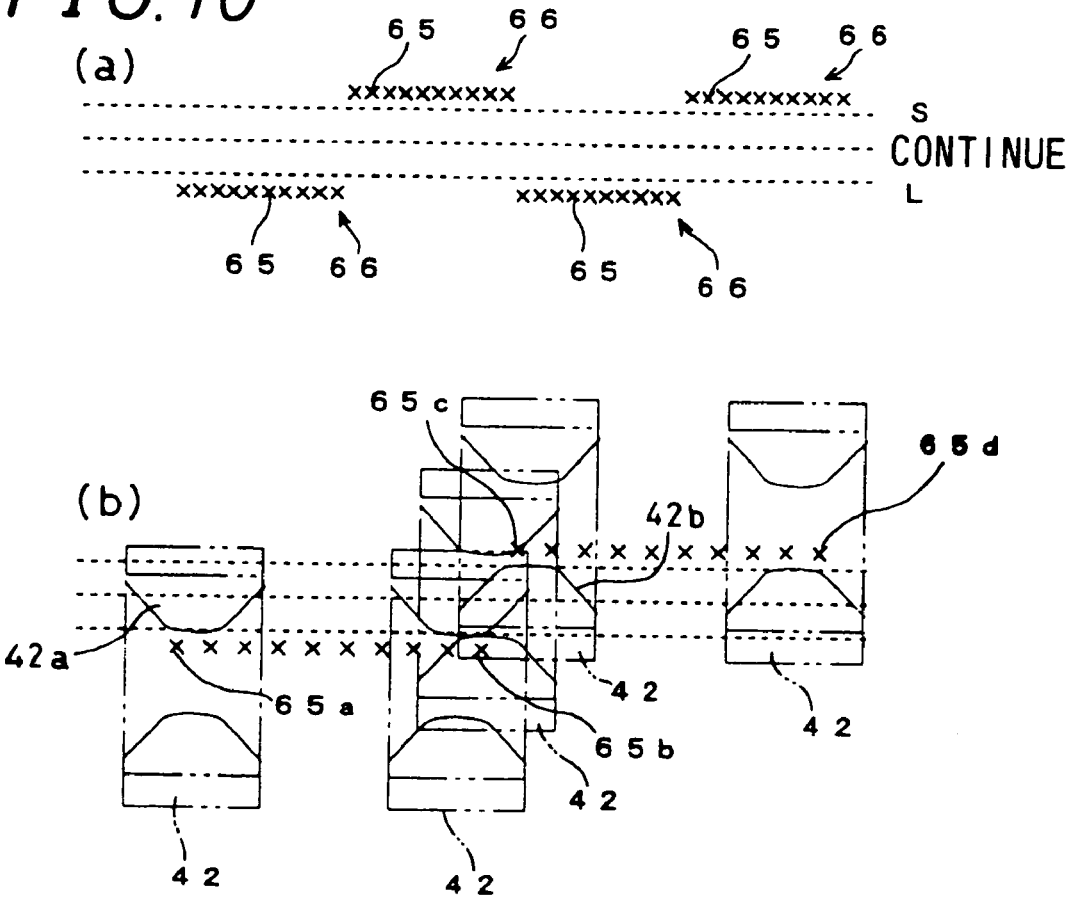
FIG. 10 shows diagrams of an example of the switching when the movable sinker apparatus of the embodiment in FIG. 1 is used in a knitting operation of a knitting fabric.

FIG. 10 shows an example where the stroke of the sinker plate 2 is switched within the same course, when a knitting operation of a knitting fabric is performed with the movable sinker apparatus in this embodiment. "L" shows a region in which the position is switched to the one with a long stroke in the first stage as shown in FIG. 1(*a*). "S" shows a region in which the position is switched to the one with a short stroke in the second stage as shown in FIG. 1(*b*). "Continue" means that the switching is not performed. For example, FIG. 10(*a*) shows an example in which "L" and "S" are alternately switched in zones 66 where a plurality of knitting needles 65 are formed in line. When the carriage 30 traverses this course, the position of the swing cam 42 is switched by operating the switching mechanism 40 as shown in FIG. 10(*b*). For convenience, FIG. 10(*b*) shows the gaps between the knitting needles 65 wider than those in FIG. 10(*a*).

It is assumed that the carriage 30 moves from left to right. The swing cam 42 is switched to the "L" side before the rear end portion of the press portion 42*a* of the swing cam 42 passes through the first knitting needle 65*a* in the first zone 66 that is to be on the "L" side in the FIG. 10(*a*). The swing cam 42 stays on the "L" side until the front end portion of the press portion 42*a* passes through the last knitting needle 65*b* of this zone. Next, the swing cam 42 is switched to the "S" side before the rear end portion of the press portion 42*b* of the swing cam 42 passes through the first knitting needle 65*c* in the zone 66 that is to be on the "S" side. The swing cam 42 stays on the "S" side until the front end portion of the press portion 42*b* passes through the last knitting needle 65*d* of this zone. In this manner, it is possible to perform switching for each zone 66 as shown in FIG. 10(*a*). When the length of the zone 66 is longer than the length between the front end portion and the rear end portion of the press portions 42*a* and 42*b* of the swing cam 42, the switching of the swing cam 42 between the knitting needles 65*b* and 65*c* in adjacent zones has a margin with a length between the front end portion and the rear end portion of the press portions 42*a* and 42*b*, so that switching can be performed satisfactory even when the carriage 30 moves at high speed.

When knitting with different sinker strokes for each zone 66 as shown in FIG. 10, and the same switched state continues during a plurality of courses, provided that the zone is switched to the zone 66 designated at the start of knitting the first course, it is sufficient to keep the swing cam 42 in the "continue" state when the following courses are knitted. When there is no switching in the middle of a course and the switching is performed at the unit of the course, the swing cam 42 may be switched before the course starts to be knitted. When there is a change in the zone 66 across the courses, the course and the knitting needle 65 are designated by numbers for switching. When knitting data are formed using a design system that forms data for a knitting operation of a knitting fabric, a designation of the zones with the different sinker stroke is set to be possible so that control data for switching are output based on the designation. Furthermore, the sinker stroke can be switched at each of the knitting needles 65, when the switching is set to be performed every time when the rear end portion of the press portions 42*a* and 42*b* of the swing cam 42 reaches the position of the corresponding knitting needle 65.

In the case of switching for every knitting needle 65 or at a short zone 66, it may be difficult to switch at a precise position when the carriage 30 moves at high speed, and it may be necessary to reduce the moving speed of the carriage 30 at the switching positions. However, when the switched state is maintained, it is not necessary to reduce the moving speed of the carriage 30, and the knitting operation is effectively performed.

Figure 11:
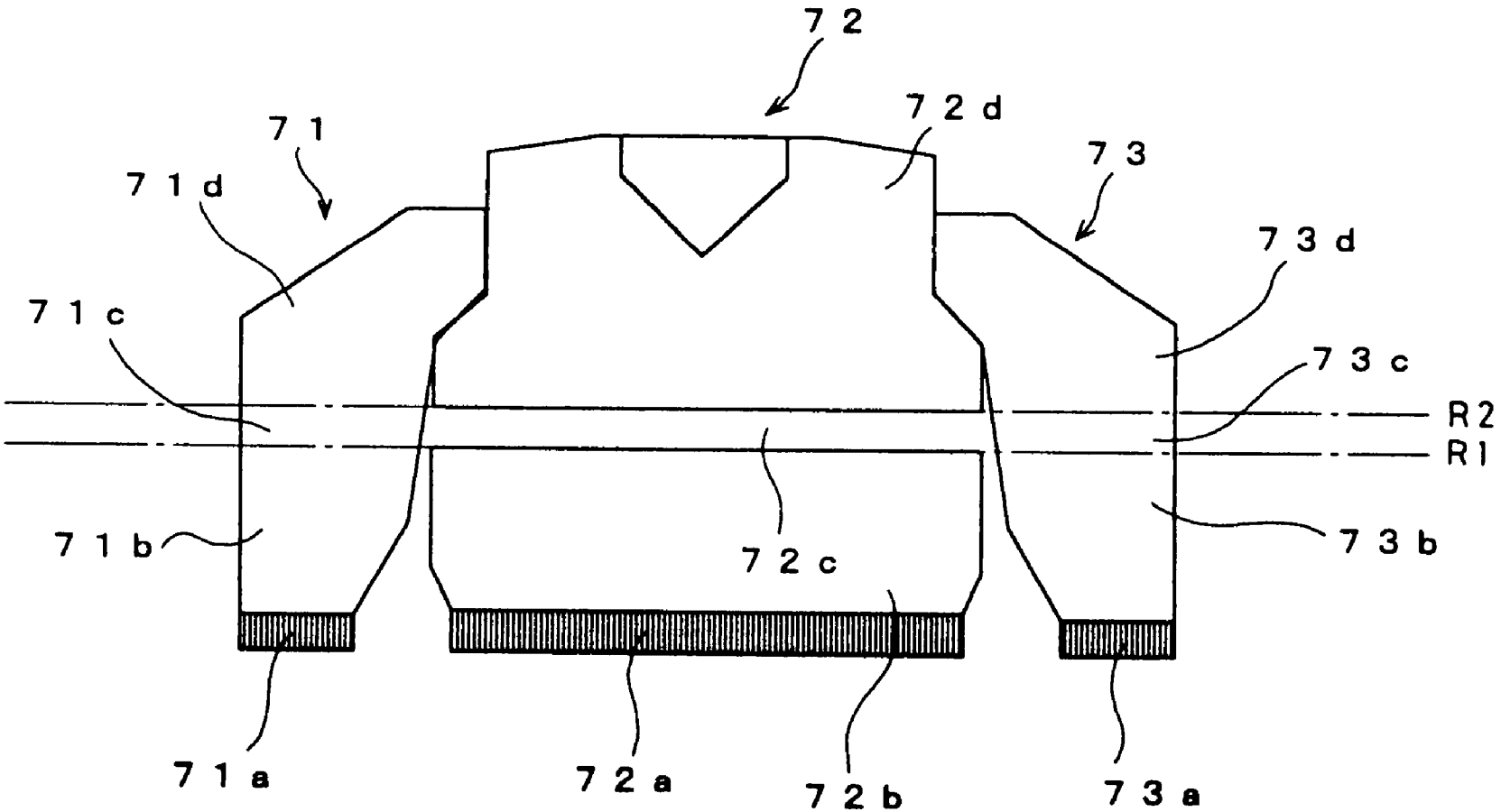
FIG. 11 is a diagram of an example of the a knitting fabric that is knitted with the movable sinker apparatus of the embodiment in FIG. 1.

FIG. 11 shows an example of the a knitting fabric that can be preferably knitted using the switching function of the movable sinker apparatus of this embodiment. In FIG. 11, when knitting a sweater 70 using the front and the rear needle beds or the like so that a cylindrical shape is formed without sewing, a right sleeve 71, a body 72, and a left sleeve 73 start to be knitted simultaneously, and the body 72 stops being knitted in mid-course so that the right sleeve 71 and the left sleeve 73 are made longer than the body 72.

For example, the carriage moves on the needle bed from left to right, and the course knitting operations of the right sleeve 71, the body 72, and the left sleeve 73 are performed in this order. Next, the carriage is reversed from the left direction to the right direction, and the course knitting operations of the left sleeve 73, the body 72, and the right sleeve 71 are performed in this order. By repeating such knitting operations, the right sleeve 71, the body 72, and the left sleeve 73 are knitted simultaneously. Therefore, after starting to knit simultaneously, the skirt portions 71*a*, 72*b*, and 73*c* of the right sleeve 71, the body 72, and the left sleeve 73, respectively, are knitted and the lower portions 71*b*, 72*b*, and 73*b* of the right sleeve 71, the body 72, and the left sleeve 73, respectively, are knitted until a stage R1. During this procedure, the knitting operations are performed with long strokes.

From the stage R1 till a stage R2, the middle portions 71*c* and 73*c* of the right sleeve 71 and the left sleeve 73 are continuously knitted. However, the middle portion 72*c* of the body 72 stops being knitted. The knitting stitches of the body 72 that have stopped being knitted are held in knitting needles, and wait for the middle portions 71*c* and 73*c* of the right sleeve 71 and the left sleeve 73 to be knitted. While the right sleeve 71 and the left sleeve 73 are knitted in this manner, the carriage passes above the knitting needles that hold the knitting stitches of the body 72. In this case, it is sufficient to set the middle portion 72*c* of the body 72 at a short stroke zone, and the middle portions 71*c* and 73*c* of the right sleeve 71 and the left sleeve 73 at long stroke zones. After the stage R2, the upper portions 71*d*, 72*d*, and 73*d* of the right sleeve 71, the body 72, and the left sleeve 73 can be knitted with long strokes. When the right sleeve 71, the body 72, and the left sleeve 73 have the same length, all portions can be knitted with long strokes. When the body 72 is longer than the right sleeve 71 and the left sleeve 73, it is sufficient to stop knitting the right sleeve 71 and the left sleeve 73 in mid-course and to set the zone for short stroke for further knitting.

When the first stage where the movement with a long stroke is possible as shown in FIG. 1(*a*) is selected in switching, an impact that is caused when the knitting yarn stopping portion 2*a* of the sinker plate 2 hits a knitting yarn increases, so that there is a possibility to cause "yarn thinning" and "nap" and damage the knitting yarn. When switching the second stage with a short stroke as shown in FIG. 1(*b*) is selected in switching at the portion where a binding stitch treatment is performed, an impact that is caused when the knitting yarn stopping portion 2*a* hits a knitting yarn can be reduced, so that a possibility to damage the knitting yarn can be reduced. Since the amount of movement of the sinker plate 2 forward to the tooth portion 6 is small when the second stage is selected, a possibility to damage a knitting yarn in a racking operation that causes relative movements of the needle beds can be also reduced.

In the embodiment described above, a stroke of the sinker plate 2 can be switched between two stages. However, the stages may be three or more. The holding member 12 is displaced by swinging by the switching mechanism 40 with stepping motor 46 as a driving force. However, the holding member 12 may be displaced by swinging by other actuators such as a solenoid. A stroke of the sinker plate 2 may be defined by a member that is displaced by sliding such as the first example disclosed in Japanese Unexamined Patent Publication JP-A 9-31806(1997), as well as the holding member 12 that is displaced by swinging. It is of course possible to use a compound needle or the like instead of a latch needle as the knitting needle 16.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

As described above, according to the invention, the amount of the movement of a knitting yarn stopping portion of a sinker plate applied with a force of a spring forward to a tooth portion to press down a previous loop can be switched by switching means between a first stage with the largest amount of movement and a second stage in which the amount is smaller than that in the first stage. When the second stage is selected in switching, in a knitting operation in which a carriage repeats to move, even when the sinker plate applied with a force of a spring repeats to return after the knitting yarn stopping portion of the sinker plate is withdrawn from the tooth portion at a position where a knitting needle is fed with a yarn, the level of a damage that is caused when the knitting yarn stopping portion hits a knitting yarn can be reduced than in the first stage with the largest amount of movement. In a knitting condition where a damage of a knitting yarn will not become a problem, it is possible to knit, taking good advantage of an effect of pressing down a knitting fabric with the knitting yarn stopping portion by switching to the first stage with the largest amount of movement of the sinker plate forward to the tooth portion.

Furthermore, according to the invention, the switching means lets the sinker plate withdraw from the tooth portion at a position where a knitting needle is fed with a yarn so as to prevent the knitting yarn stopping portion at the front end portion of the sinker plate from being brought in contact with a knitting yarn that is supplied from a yarn feeding member or the like, and the switching means can switch between the first stage and the second stage by linking the displacement of the sinker plate with the switching of the holding means in the switching position.

Furthermore, according to the invention, a projection portion of the holding means is pressed between a pair of press portions of the switching means for switching such that different positions are taken between the first stage and the second stage. The switched state of the sinker plate can be held by switching to a state in which neither of the press portions presses the projection portion of the holding means.

Furthermore, according to the invention, the holding means can hold the switched state by being engaged with an abutting portion of the sinker plate in the second stage. The switched state of each of the first stage and the second stage can be also held by a protrusion provided on a plate spring. When the switching means switches between the first stage and the second stage, the protrusion of the plate spring moves backward from the holding means, so that the protrusion can be surmounted.

Furthermore, according to the invention, the switching means is provided with a swing cam in which the pair of press portions are formed, and that is displaced by swinging so as to include an area in which the projection portion of the holding means is displaced between the press portions. The swing cam can be displaced by swinging by a stepping motor via a linking mechanism, so that the sinker plate is switched to the first stage or the second stage, or to the state where the switched state is not changed. The switching can be performed independently from the other operations of the carriage. The amount of movement forward to the tooth portion can be switched between knitting courses of a knitting fabric and in the middle of a course, so that zones having different pressing amounts of the sinker can be formed.

What is claimed is:

1. A flat knitting machine comprising:

a movable sinker apparatus including a plurality of sinker plates which are disposed along a longitudinal direction of a needle bed, and to which a force of a spring is applied so that a knitting yarn stopping portion at its front end portion moves forward to a tooth portion formed between the front and the rear needle beds that are opposed to each other, in the movable sinker apparatus the knitting yarn stopping portion being withdrawn from the tooth portion at a position where a knitting needle is fed with a yarn and being moved forward to the tooth portion at least at a time of knock-over after forming a new loop, by an action of a carriage moving along the longitudinal direction of the needle bed, so that a previous loop is pressed down, the flat knitting machine comprising:

switching means provided in the carriage for switching an amount of movement of the knitting yarn stopping portion of the sinker plate forward to the tooth portion by a force of a spring to a plurality of stages including a first stage with the largest amount of movement in one course, at a predetermined switching position that is outside a range in which a knitting needle performs a knitting operation; and holding means provided for each sinker plate, for holding a switched state when the amount of movement of the sinker plate forward to the tooth portion is switched to a second stage in which the amount is smaller than that in the first stage by the switching means.

2. The flat knitting apparatus of claim 1, wherein the sinker plate includes an abutting portion that is brought in contact with the holding means in the second stage, and the switching means lets the sinker plate withdraw from the tooth portion by resisting the spring force at a position where the knitting needle is fed with a yarn and at the switching position, and switches to a state in which the abutting portion of the sinker plate is brought in contact with the holding means when switching to the second stage.

3. The flat knitting machine of claim 2, wherein the holding means includes a projection portion with which the switching means can be in contact for switching such that different positions are taken between the first stage and the second stage, and the switching means includes a pair of press portions that are opposed to each other with a gap wider than that in which the projection portion of the holding means is displaced between the first stage and the second stage, presses the projection portion of the holding means by either one of the press portions when switching to the first stage or to the second stage, and can switch to a state in which neither of the press portions presses the projection portion of the holding means.

4. The flat knitting machine of claim 3, wherein the holding means holds the switched state by being engaged with the abutting portion of the sinker plate in the second stage, a plate spring including a protrusion that can hold the switched stage of the holding means in each of the first stage and the second stage is further provided, and the holding means is displaced by surmounting the protrusion of the plate spring when the switching means switches between the first stage and the second stage.

5. The flat knitting machine of claim 4, wherein the switching means includes:

a swing cam in which a pair of press portions are formed, and that is swingingly displaced so as to include an area in which the projection portion of the holding means is displaced between the press portions, a stepping motor whose rotational state is controlled in accordance with an electrical command, and a linking mechanism that swingingly displaces the swing cam based on a rotational power of the stepping motor.

* * * * *